US006874784B1

(12) United States Patent
Promutico et al.

(10) Patent No.: US 6,874,784 B1
(45) Date of Patent: Apr. 5, 2005

(54) METHOD FOR PLAYING A CARD GAME

(76) Inventors: Rocco R. Promutico, 3235 Osborn Ter., Toms River, NJ (US) 08753; Kara L. Nemeth, 105 First St., Medford, MA (US) 02155

( * ) Notice: Subject to any disclaimer, the term of this patent is extended or adjusted under 35 U.S.C. 154(b) by 56 days.

(21) Appl. No.: 10/383,706

(22) Filed: Mar. 7, 2003

(51) Int. Cl.[7] ..... A63F 1/00

(52) U.S. Cl. ..... 273/292; 273/274; 273/309; 463/12

(58) Field of Search ..... 273/292, 274, 273/309; 463/13

(56) References Cited

U.S. PATENT DOCUMENTS 5,320,356 A * 6/1994 Cauda ..... 273/292
5,328,189 A * 7/1994 Malek ..... 273/292
5,407,209 A * 4/1995 Prerost ..... 273/292
5,415,414 A * 5/1995 Savage ..... 273/306
5,660,392 A * 8/1997 Hansen ..... 273/292
6,419,578 B1 * 7/2002 Moody et al. ..... 463/13
6,428,002 B1 * 8/2002 Baranauskas ..... 273/236
6,457,715 B1 * 10/2002 Friedman ..... 273/274
6,547,246 B2 * 4/2003 Webb ..... 273/292
6,561,898 B2 * 5/2003 Moody ..... 463/13
6,575,467 B1 * 6/2003 Kal ..... 273/292
6,585,587 B2 * 7/2003 Falciglia, Sr. ..... 463/13
6,602,134 B2 * 8/2003 Wood et al. ..... 463/13
6,659,461 B2 * 12/2003 Yoseloff et al. ..... 273/274
6,669,198 B2 * 12/2003 Wichinsky ..... 273/292
6,672,959 B2 * 1/2004 Moody et al. ..... 463/13
6,676,128 B2 * 1/2004 Wolf ..... 273/292
6,695,695 B2 * 2/2004 Angel ..... 463/13
6,708,975 B1 * 3/2004 Fox et al. ..... 273/292
6,733,012 B2 * 5/2004 Bui et al. ..... 273/292
2002/0036381 A1 * 3/2002 Scibetta ..... 273/292
2002/0149153 A1 * 10/2002 Wichinsky ..... 273/292
2002/0195775 A1 * 12/2002 Webb et al. ..... 273/292
2003/0034608 A1 * 2/2003 Bui et al. ..... 273/274

* cited by examiner

*Primary Examiner*—Gregory Vidovich
*Assistant Examiner*—Dolores R. Collins
(74) *Attorney, Agent, or Firm*—Raymond A. Nuzzo

(57) ABSTRACT

A card game wherein a first set of cards is dealt face up and arranged in a row. Each card represents a first card of one hand of a plurality of separate hands that will be completely formed when the dealer deals all cards necessary to complete all of the separate hands. A first difficulty factor is assigned to the first set of cards. Wagers may be placed on each card in the first set. This process is then repeated for a second set of cards and a third set of cards. Additional sets of cards are dealt face up and arranged in rows that are aligned with rows of cards formed by the first, second and third sets of card thereby forming a plurality of rows and columns of cards. Each column of cards defines a separate and complete hand of cards. Winnings are paid to the player with the winning hand based on (i) the player's wagers that correspond to the winning hand, (ii) a predetermined payout schedule and (iii) the difficulty factors.

10 Claims, 6 Drawing Sheets

METHOD FOR PLAYING A CARD GAME

BACKGROUND OF THE INVENTION

1. Field of the Invention

The present invention generally relates a method for playing a card game.

2. Description of Related Art

Currently, casinos use a variety of games for wagering. Many of these games are varieties of mechanical or electronic slot machines. Despite the popularity of slot machines, pokers, blackjack or twenty-one, keno, baccarat, craps and other traditional games played at a table are the foundation of casino play. Players are known to enjoy the novelty of new table games because the old games have become too well known by the players or because the players perceive some of the traditional games as being overly complicated. Moreover, since table games usually have larger stakes than slot machines, casinos have an interest in developing new table games for the clientele. Card games are one of the most popular types of table games available at casinos. Prospective players are always looking for new card games that are challenging and exciting. On the other hand, casinos and wagering establishments are interested in card games that will (i) attract more players, (ii) create player loyalty, and (iii) increase revenues to the casinos and wagering establishments.

What is needed is a unique card game that meets the needs of the players and casinos or wagering establishments. Accordingly, it is an object of the present invention to provide a new card game that is challenging, exciting and entertaining.

it is another object of the present invention to provide a new card game that is short in duration so as to provide casinos or wagering establishments with increased revenues.

It is another object of the present invention to provide a new card game that attracts more players.

It is another object of the present invention to provide a new card game that is easy to learn.

Other objects and advantages of the present invention will be apparent to one of ordinary skill in the art in light of ensuing description of the present invention.

SUMMARY OF THE INVENTION

The present invention is directed to, in one aspect, a method of playing a card game comprising the steps of providing at least one set of playing cards, dealing a first set of cards all face up wherein each card represents a first card of one hand of a plurality of separate hands that are going to be completely formed when the dealer deals all cards necessary to complete all of the separate hands, providing a player with the opportunity to make a wager on each of the cards of the first set, dealing a second set of cards all face up wherein each card of the second set represents a second card of one hand of the plurality of separate hands that are going to be completely formed when the dealer deals all cards necessary to complete all of the separate hands, providing a player with the opportunity to make a wager on each of the cards of the second set, dealing a third set of cards all face up wherein each card of the third set represents a third card of one hand of the plurality of separate hands that are going to be completely formed when the dealer deals all cards necessary to complete all of the separate hands, providing a player with the opportunity to make a wager on each of the cards of the third set, dealing additional sets of cards all face up to complete all of the separate hands wherein each card of each additional set of cards combines with corresponding cards of the first, second and third sets of cards to form the plurality of separate hands, determining the poker hand ranking of each of the separate hands, determining which of the hands is the winning hand, and paying to the player winnings based on predetermined odds, the amount of the player's wagers associated with the cards of the winning hand, and difficulty factors corresponding to the cards of the winning hands.

DESCRIPTION OF THE PREFERRED EMBODIMENTS

The card game of the present invention can be played with up to eight players plus the dealer. A single player also may play the card game. The players are sitting or standing adjacent a portion of the game table designated as a player station. In one embodiment, all of the sets of cards are contained in a shoe, known in the art, from which the dealer may draw one card at a time. In another embodiment, all of the sets of cards are contained in an automatic card shuffler. As used herein, the terms "wager" and "bet" have the same meaning and are used interchangeably.

Figure 1:
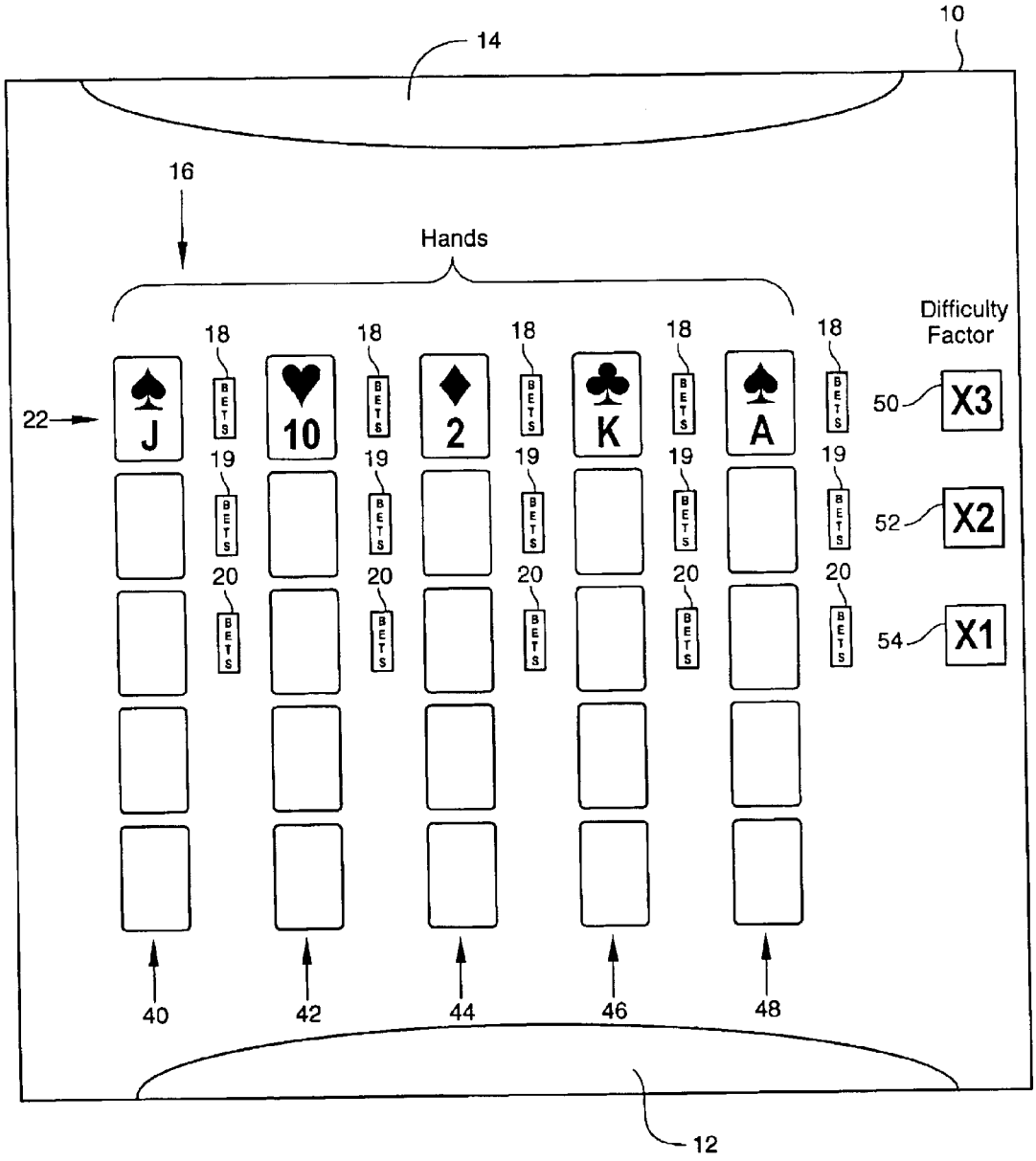
FIG. 1 shows the game table after a first set of cards is dealt by the dealer.

Referring to FIG. 1, there is shown one embodiment of game table 10 that is used in playing the card game of the present invention. Game table 10 includes a player playing station or area 12 and a dealer playing station or area 14. Game table 10 further includes a card distribution area 16 wherein the dealer places dealt cards. As shown in FIG. 1, the playing cards are placed on game table 10 so that the cards face the player or players and are arranged in row-column format. This feature of the invention is described in detail in the ensuing description. Game table 10 includes betting areas 18, 19 and 20 for receiving players' bets or wagers. Although game table 10 is shown have a generally square shape, it is to be understood that game table 10 can have other shapes known in the art, e.g. semi-circular.

Figure 2:
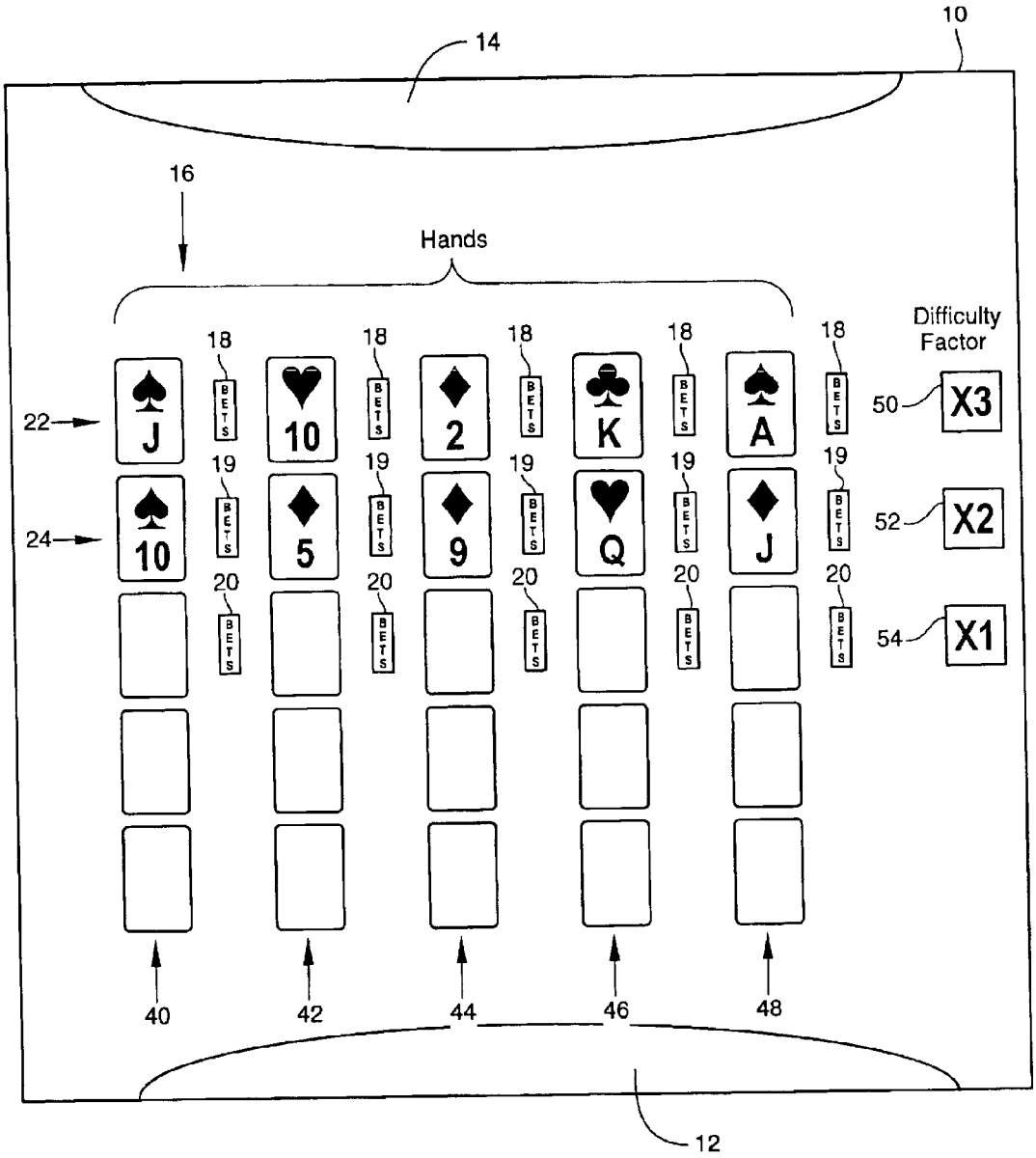
FIG. 2 shows the game table after a second set of cards is dealt by the dealer.
Figure 3:
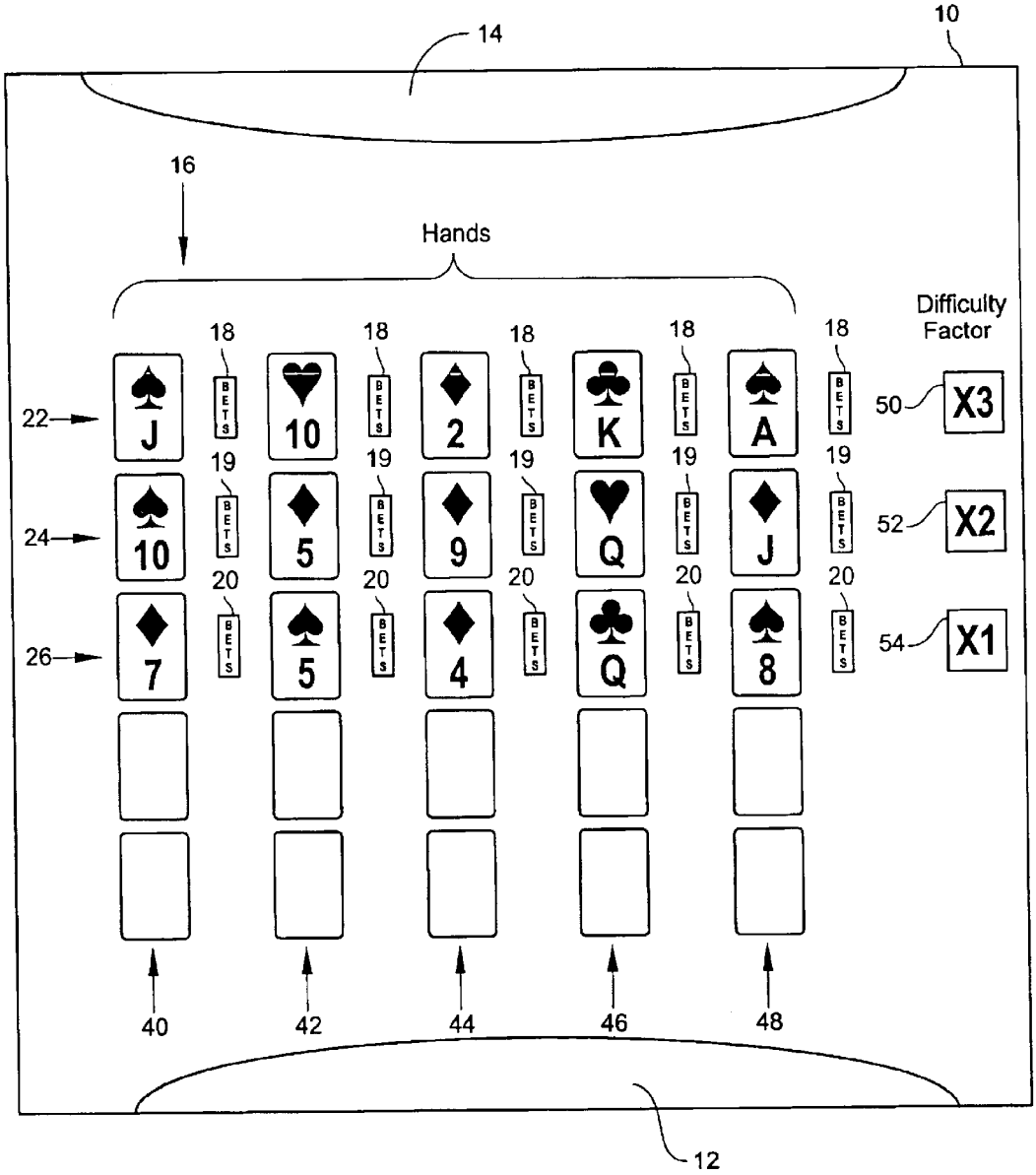
FIG. 3 shows the game table after a third set of cards is dealt by the dealer.
Figure 4:
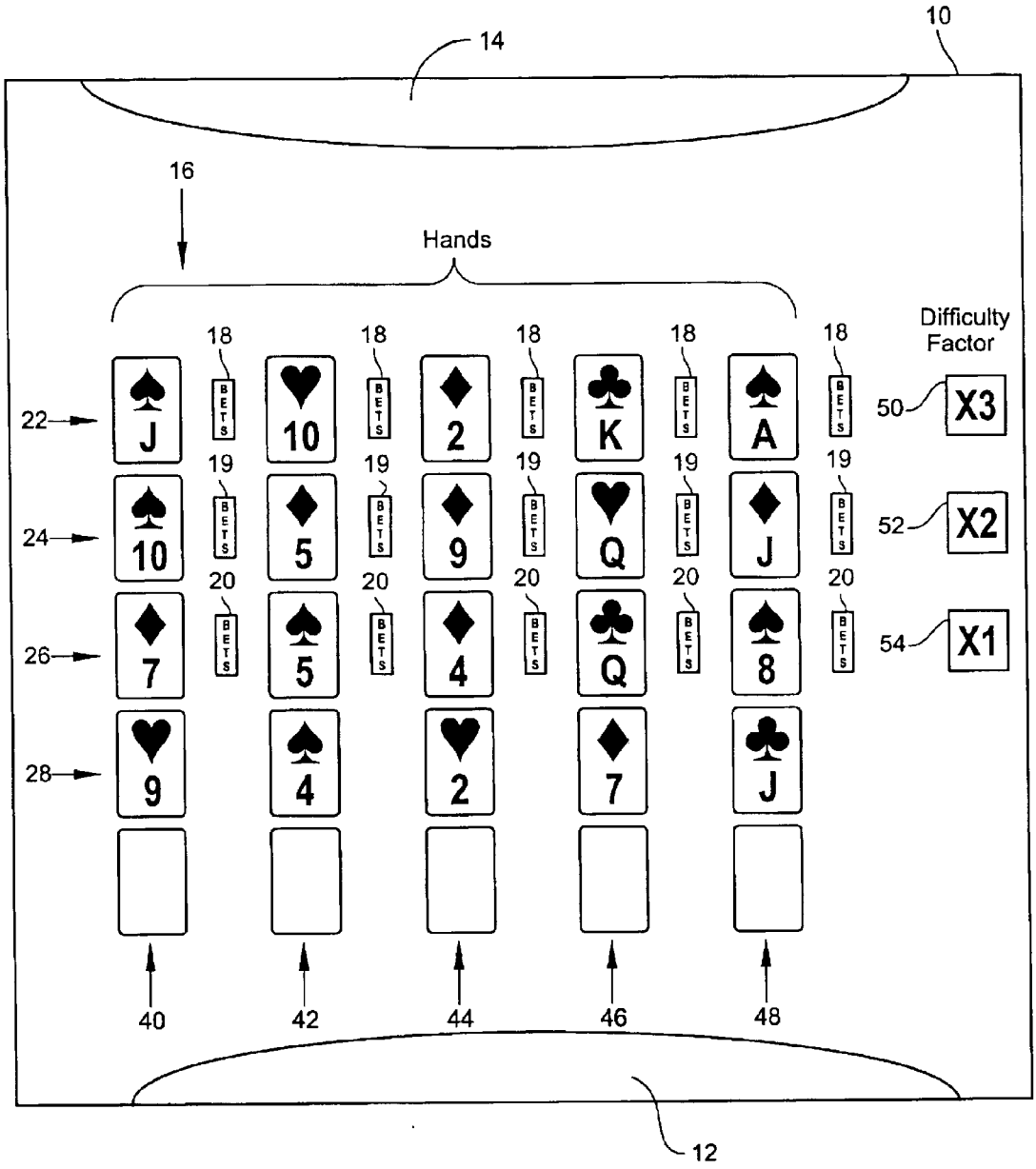
FIG. 4 shows the game table after a fourth set of cards is dealt by the dealer.
Figure 5:
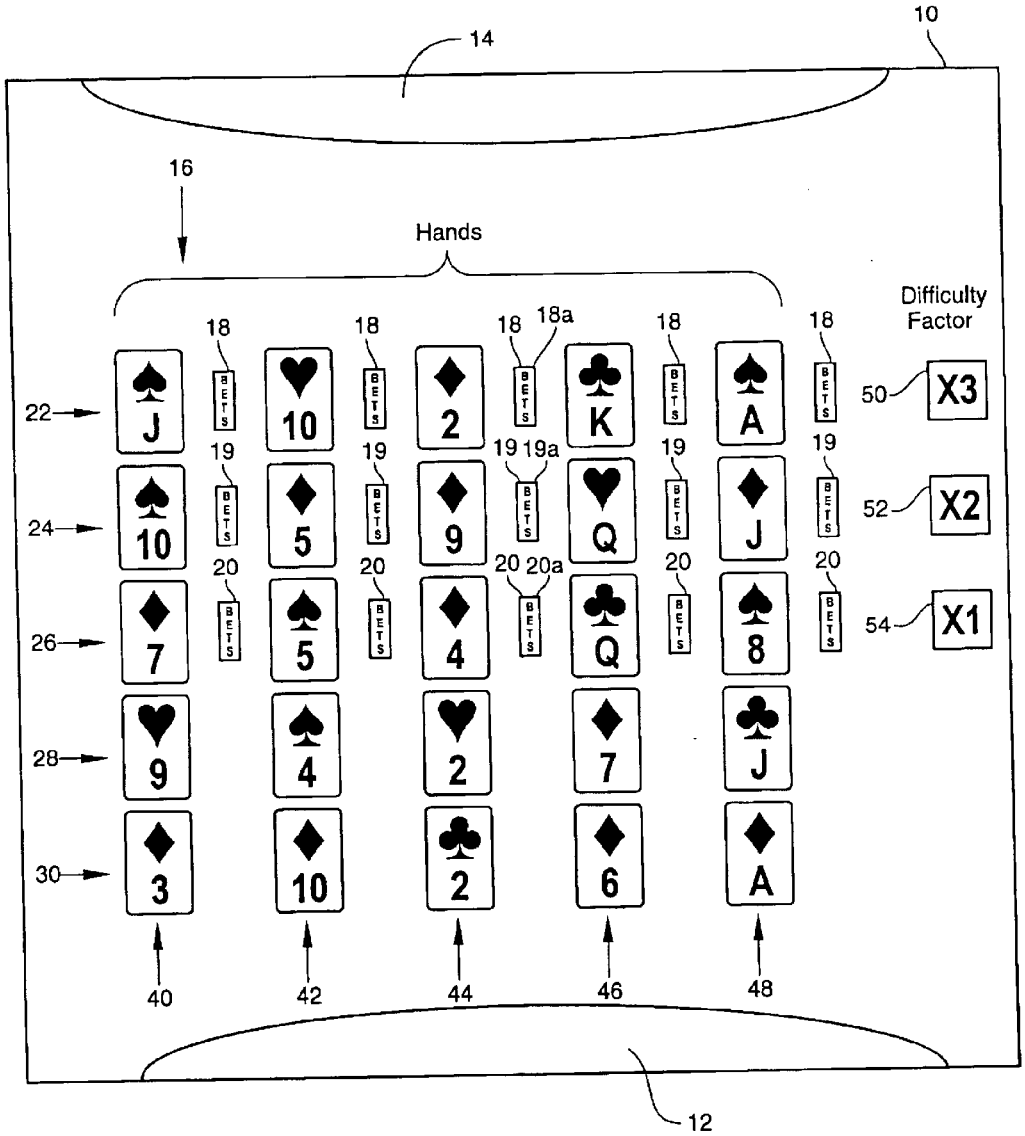
FIG. 5 shows the game table after a fifth set of cards is dealt by the dealer.

Referring to FIG. 1, the first step of playing the card game of the present invention is to provide at least one deck of playing cards. The actual number of decks of playing cards used depends upon the number of hands dealt by the dealer (i.e. the house). Next, the dealer deals a first set of cards all face up to form first row 22. The dealer preferably deals the cards in a left to right motion starting from the dealer's left. Each card represents a first card of one hand of a plurality of separate hands that are going to be completely formed when the dealer deals all cards necessary to complete all of the separate hands. Each complete hand is formed by the cards in each column 40, 42, 44, 46 and 48. Next, the dealer provides a player with the opportunity to make a wager on each of the card's of the first set. Thus, the players may place a bet in any or all of the betting areas 18. A player can only place a wager when the dealer indicates that the players may do so. If the players do not exercise their option of placing wagers, they lose the opportunity to do so and cannot go back later and place that particular wager. Next, the dealer deals a second set of cards all face up to form second row 24. This is illustrated in FIG. 2. Each card of the second set represents a second card of one hand of the plurality of separate hands that will be completely formed when the dealer deals all cards necessary to complete all of the separate hands. The dealer then provides the players with the opportunity to make a wager on each of the cards of the second set. Thus, the players may place a bet in any or all of the betting areas 19. Referring to FIG. 3, the dealer then deals a third set of cards all face up so as to form row 26. Each card of this third set represents a third card of one hand of the plurality of separate hands that are going to be completely formed when the dealer deals all cards that are necessary to complete all of the separate hands. The dealer then provides a player with the opportunity to make a wager on any or all of the cards of the third set. Thus, the players may place a bet on any or all of the betting areas 20. Referring to FIGS. 4 and 5, the dealer then deals additional sets of cards all face up to form rows 28 and 30. If the dealer decides that each hand will have five cards, the cards of rows 28 and 30 are combined with corresponding cards of the first, second and third sets of cards to form the plurality of separate and complete hands defined by columns 40, 42, 44, 46 and 48. In a preferred embodiment, if each hand has five cards, the players are not permitted to place bets on any cards in rows 28 and 30. Thus, in such an embodiment, players can place bets only on the cards in rows 22, 24 and 26.

Referring to FIG. 5, the next steps are to determine the poker hand ranking of each complete hand defined by columns 40, 42, 44, 46 and 48, and determine which of the hands is the winning hand. Next, the dealer must pay the player with a winning hand an amount of winnings that is based on (i) the player's bets on betting areas 18, 19, and 20, (ii) the pay-off odds shown in Table I, and (iii) predetermined difficulty factors associated with rows 22, 24 and 26. As shown in FIG. 1-5, these difficulty factors are indicated in areas 50, 52 and 54 on game table 10. Area 50 corresponds to row 22. Area 52 corresponds to row 24. Area 54 corresponds to row 26. Thus, these difficulty factors correspond to wagers that are placed on cards in rows 22, 24 and 26. The predetermined difficulty factor associated with row 22 is the highest difficulty factor. This is because when a player places a bet on the betting area 18 after the first set of cards is dealt, he or she is betting that the hand associated with that first card will be the winning hand. Thus, the player is betting that the hand having that first card will be the winning hand even though the player has only seen the first card of that hand. As described in the foregoing description, a player can only place a bet on cards in a particular row when the dealer indicates that the players may do so. If the players do not exercise their option of placing belts on cards in particular rows, they lose the opportunity to do so and cannot place bets in those rows later in the game. As more sets of cards are dealt, each player gets a better idea as to whether the hand defined by each column 40, 42, 44, 46 and 48 will be a winning hand. Therefore, the difficulty factor decreases with subsequent rows. Referring to FIG. 5, the winning hand is in column 44 and which has three of a kind (i.e. three twos). According to the odds in Table I, there is a 3to-1 pay-off for a hand having three-of-a-kind. Therefore, if a player bet $5.00 in a betting area 18*a,* the player would be paid $15.00. Since the cards in row 22 have a difficulty factor of three, the player is entitled to a pay-off equal to $15.00 times the difficulty factor (i.e. 3). As a result, the player is entitled to $45.00. This pay-off scheme is also applied to subsequent rows as well. For example, if the player also bet $5.00 on betting area 19*a,* the player would be paid another $30.00 since the difficulty factor of row 24 is two (i.e. $5.00×3×2). This would bring the player's total winnings to $75.00. If the player also placed a $5.00 bet on betting area 20*a,* the player would receive another $15.00 because the difficulty factor for row 26 is one. Thus, the total amount of the winnings is $90. The player loses any bets that he or she made on cards that are associated with the losing hands defined by columns 40, 42, 44, 46 and 48.

TABLE I

| HAND | ODDS |
|---|---|
| Pair, Jack or Better | 1 to 1 |
| Two Pair | 2 to 1 |
| Three of a Kind | 3 to 1 |
| Straight | 5 to 1 |
| Flush | 10 to 1 |
| Full House | 15 to 1 |
| Four of a Kind | 20 to 1 |
| Straight Flush | 50 to 1 |
| Royal Flush | 100 to 1 |

It is to be understood that the pay-off schedule shown in Table I is just one example and that other pay-off odds are possible. The house or casino will have the option to set all odds and values of the winning hands. Furthermore, the dealer (i.e. house, casino, etc.) can use different difficulty factors as well. Accordingly, the house or casino decides how many hands are to be played and how many cards will be in each hand. In an alternate embodiment of the card game of the present invention, the dealer uses wild cards. In a further embodiment, the house or casino uses a bonus or progressive pot.

Figure 6:
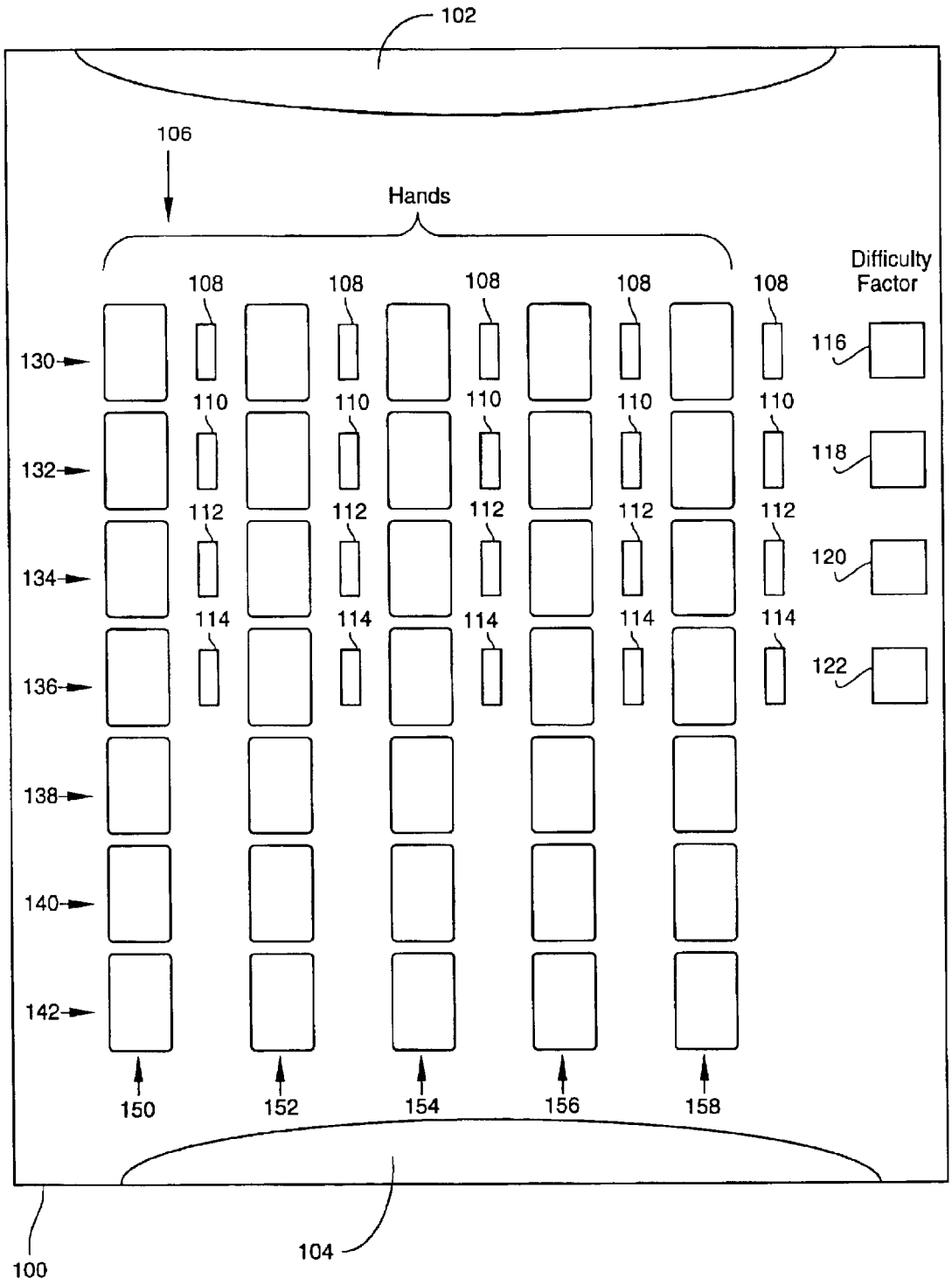
FIG. 6 shows the game table in accordance with another embodiment of the invention.

It is to be understood that the layout of game table 10 will change depending on how many hands are to be played and how many cards will be in each hand. Thus, although the foregoing description and FIGS. 1–5 show that each hand defined by columns 40, 42, 44, 46 and 48 has five cards, it is to be understood that the card game of the present invention can be played so that each hand has four cards or more than five cards (e.g. seven cards). In a preferred embodiment, if each hand is to have seven card, the players are provided an opportunity to place bets on cards in row 28. This embodiment is shown in FIG. 6. Game table 100 is configured to have a dealer playing area 102, player playing area 104, card distribution area 106, betting areas 108, 110, 112, and 114, and difficulty factor areas 116, 118, 120 and 122. Card distribution area 106 is configured to have seven rows 130, 132, 134, 136, 138, 140 and 142, and five columns 150, 152, 154, 156 and 158. When the dealer deals seven sets of cards, each of these columns defines a separate and complete hand wherein each hand has seven cards. In this embodiment, the dealer provides the players with opportunities to place bets in betting areas 108, 110, 112, and 114 which correspond to rows 130, 132, 134, 136, respectively.

It is be understood that the card game of the present invention can be played: (i) in a casino or other wagering establishment in a manner similar to conventional card games, i.e. "live table version" wherein a group of players and a dealer are positioned at a gaming table, (ii) on electronic video poker gaming machines located in a casino other wagering establishment, or (iii) on linked, electronic video poker gaming machines located in a casino or wagering establishment. Electronic video poker gaming machines are generally described in U.S. Pat. Nos. 6,517,074, 6,478,675, and 5,823,873. The card game of the present invention also can be implemented on slot machines. Furthermore, the card game of the present invention also can be implemented with scratch-type lottery tickets.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A method of playing a card game comprising:

providing at least one set of playing cards;

dealing a first set of cards all face up and in a manner such that the cards are arranged in a row, each card representing a first card of one hand of a plurality of separate hands that are going to be completely formed when a dealer deals all cards necessary to complete all of the separate hands;

assigning a first difficulty factor to the row of cards formed by the first set of cards;

providing a player with the opportunity to make a wager on each of the cards of the first set;

dealing a second set of cards all face up and in a manner such that the cards of the second set are arranged in a row and are adjacent to and aligned with the row of cards formed by the first set of cards, each card of the second set representing a second card of one hand of the plurality of separate hands that are going to be completely formed when the dealer deals all cards necessary to complete all of the separate hands;

assigning a second difficulty factor to the row of cards formed by the second set of cards;

providing a player with the opportunity to make a wager on each of the cards of the second set;

dealing a third set of cards all face up and in a manner such that the cards of the third set are arranged in a row and adjacent to and aligned with the row of cards formed by the second set of cards, each card of the third set representing a third card of one hand of the plurality of separate hands that are going to be completely formed when the dealer deals all cards necessary to complete all of the separate hands;

assigning a third difficulty factor to the row of cards formed by the third set of cards;

providing a player with the opportunity to make a wager on each of the cards of the third set;

dealing additional sets of cards all face up to complete all of the separate hands of cards, the additional sets of cards being dealt so that the additional sets of cards are arranged in rows that are aligned with the rows of cards formed by the first, second and third sets of cards thereby forming a plurality of rows and columns of cards, each column of cards defining a separate and complete hand of cards;

determining the poker hand ranking of each separate and complete hand of cards;

determining which of the separate and complete hands of cards is the winning hand; and paying winnings to the player based on (i) the player's wagers that correspond to the winning hand, (ii) a predetermined payout schedule and (iii) the difficulty factors.

2. The method according to claim 1 wherein each of the separate and complete hands has at least four cards.

3. The method according to claim 1 wherein each of the separate and complete hands has more than five cards.

4. The method according to claim 1 wherein the step of dealing additional sets of cards comprises dealing a fourth set of cards.

5. The method according to claim 4 wherein the step of dealing additional sets of cards comprises dealing a fifth set of cards.

6. The method according to claim 4 further comprising the step of providing a player with the opportunity to make a wager on each card in the fourth set of cards.

7. The method according to claim 6 wherein the step of dealing additional sets of cards comprises:

dealing a fifth set of cards;

dealing a sixth set of cards; and dealing a seventh set of cards.

8. The method according to claim 1 wherein the difficulty factor associated with the first row of cards is the highest difficulty factor.

9. The method according to claim 8 wherein the difficulty factor decreases with subsequent rows of cards.

10. The method according to claim 1 further including the step of providing a table having a dealer station, a player station, a card distribution area for receiving the sets of cards dealt by the dealer, a plurality of betting areas wherein each betting area corresponds to a particular card in the first, second and third sets of cards, and a plurality of difficulty factor indicating areas wherein each difficulty factor indicating area corresponds to one of the first, second and third rows of cards and indicates a particular difficulty factor.

* * * * *